US007391384B2

(12) United States Patent
Wong et al.

(10) Patent No.: US 7,391,384 B2
(45) Date of Patent: Jun. 24, 2008

(54) DIGITAL-TELEVISION RECEIVING ANTENNA

(75) Inventors: Kin-Lu Wong, Kao-Hsiung (TW); Yun-Wen Chi, Taipei (TW); Saou-Wen Su, Taipei (TW)

(73) Assignees: Lite-On Technology Corp., Neihu, Taipei (TW); National Sun Yat-Sen University, Kaoshiung (TW)

( * ) Notice: Subject to any disclaimer, the term of this patent is extended or adjusted under 35 U.S.C. 154(b) by 0 days.

(21) Appl. No.: 11/464,498

(22) Filed: Aug. 15, 2006

(65) Prior Publication Data

US 2007/0195002 A1 Aug. 23, 2007

(30) Foreign Application Priority Data

Feb. 22, 2006 (TW) ..... 95105844 A

(51) Int. Cl.
*H01Q 9/28* (2006.01)
*H01Q 9/16* (2006.01)
*H01Q 13/10* (2006.01)
*H01Q 1/38* (2006.01)

(52) U.S. Cl. ..... 343/795; 343/793; 343/767; 343/700 MS

(58) Field of Classification Search ..... 343/795, 343/700 MS, 793, 767
See application file for complete search history.

(56) References Cited

U.S. PATENT DOCUMENTS

| | | | | |
|---|---|---|---|---|
| 5,182,570 | A * | 1/1993 | Nysen et al. | 343/795 |
| 6,624,793 | B1 * | 9/2003 | Su et al. | 343/795 |
| 7,151,500 | B2 * | 12/2006 | Su et al. | 343/795 |
| 2004/0222936 | A1 * | 11/2004 | Hung et al. | 343/795 |
| 2006/0284780 | A1 * | 12/2006 | Chen et al. | 343/795 |

FOREIGN PATENT DOCUMENTS

| | | |
|---|---|---|
| TW | 521455 | 2/2003 |

* cited by examiner

*Primary Examiner*—Hoang V Nguyen
*Assistant Examiner*—Robert Karacsony
(74) *Attorney, Agent, or Firm*—Winston Hsu

(57) ABSTRACT

A receiving antenna for digital television signal reception includes a dielectric substrate, a radiating plate formed on the dielectric substrate with a bar shape, having a first long edge and a second long edge corresponding to the first long edge, a slit formed on the radiating plate with a length at least two times the width of the radiating plate, having a terminal at about the center of the first long edge and a terminal at the second long edge, and separating the radiating plate into a first sub-plate and a second sub-plate, a first feeding point formed on the first sub-plate, a second feeding point formed on the second sub-plate, and a feeding coaxial cable having a core conductor connected to the first feeding point and a grounding conductor connected to the second feeding point.

9 Claims, 10 Drawing Sheets

DIGITAL-TELEVISION RECEIVING ANTENNA

BACKGROUND OF THE INVENTION

1. Field of the Invention

The present invention relates to a digital-television receiving antenna, and more particularly, to a broadband planar digital-television receiving antenna.

2. Description of the Prior Art

In the past, a TV program operator broadcasts analog signals to receivers through ultra-high-frequency (UHF) or very-high-frequency (VHF) channels. Analog signals are easily interfered during transmission, so that picture clarity, noise and ghost-image reductions are insufficient. Also, transmitting analog signals requires a considerable frequency bandwidth, which decreases the efficiency of frequency utilization. In contrary, a digital TV (DTV) system transmits TV programs with digital signals, which can be compressed to increase the efficiency of frequency utilization. Moreover, a receiver of the DTV system can process debugging or error corrections for digital signals, so that the DTV system has higher quality in video and audio, and more channel numbers. Now, the DTV system has been developed in three main standards, DVB (Digital Video Broadcasting) by European Broadcast Union (EBU), ATSC (Advanced Television Systems Committee) by US, and ISDB (Integrated Services Digital Broadcasting) by Japan. The DVB standard has been authorized by European Telecommunications Standard Institute (ETSI), and includes substandards of DVB-S (satellite), DVB-C (cable) and DVB-T (terrestrial). According to the DVB standard, a DVB system encodes video and audio signals with MPEG-2 coding technology, modulates the signals with coded orthogonal frequency division multiplexing (COFDM), and uses a frequency bandwidth of 8 MHz (23.5 Mbps). A DVB-T system can establish a single frequency network (SFN) for increasing available frequency resources, provide interactive TV functions, and reduce a multipath effect. In order to improve mobile receiving efficiency of a vehicle DVB-T receiver, advanced channel estimation is applied and a dual-antenna is used for receiving radio waves and performing diversity combining, and accordingly, circuit complexity, hardware cost, and power consumption cannot be decreased. A DTV receiving antennal is a fundamental equipment of a common DTV tuner. Most DTV receiving antennas are monopole antennas, which have large sizes and insufficient bandwidths. Therefore, a planar DTV receiving antenna having a wide bandwidth is desired.

TW patent No. 521,455 discloses a small planar DTV antenna for receiving DTV signals. However, the antenna of TW patent No. 521,455 has a large volume, so that it is inconvenient.

Referring to FIG. 2, which illustrates a schematic diagram of an antenna 2 of the prior art. The antenna 2 includes a dielectric substrate 20, a radiating plate 21, a slit 24, feeding points 25, 26, and a feeding coaxial cable 27. The dielectric substrates 20 can be a copper clad laminate substrate, or be made of film or rubber. The radiating plate 21 is formed on the dielectric substrates 20 by printing or etching. The radiating plate 21 is formed as a bar shape, and includes a first long edge 211 and a second long edge 212 corresponding to the first long edge 211. A length of the slit 24 is approximately equal to a width W of the radiating plate 21. The slit includes terminals 241 and 242. The terminal 241 is at about a center of the first long edge 211, and the terminal 142 is also at about the center of the second long edge 212. The slit 24 separates the radiating plate 21 into a first sub-plate 22 and a second sub-plate 23. The feeding points 25 and 26 are near the first long edge 211, and at the first sub-plate 22 and the second sub-plate 23, respectively. The feeding coaxial cable 27 is utilized for transmitting/receiving signals, and includes a core conductor 271 connected to the feeding point 25 and a grounding conductor 272 connected to the feeding point 26. Note that, the slit 24 is formed without any bending, or is perpendicular to the first long edge 211 and the second long edge 212.

Referring to FIG. 3, which illustrates a schematic diagram of an antenna 3 of the prior art. The antenna 3 includes a dielectric substrate 30, a radiating plate 31, a slit 34, feeding points 35, 36, and a feeding coaxial cable 37. The dielectric substrates 30 can be a copper clad laminate substrate, or be made of film or rubber. The radiating plate 31 is formed on the dielectric substrates 30 by printing or etching. The radiating plate 31 is formed as a bar shape, and includes a first long edge 311 and a second long edge 312 corresponding to the first long edge 311. The length of the slit 34 is approximately equal to the width W of the radiating plate 31. The slit includes terminals 341 and 342. The terminals 341 and 342 are at a distance (about 60 mm) from centers of the first long edge 311 and the second long edge 312. The slit 34 separates the radiating plate 31 into a first sub-plate 32 and a second sub-plate 33. The feeding points 35 and 36 are near the first long edge 311, and at the first sub-plate 32 and the second sub-plate 33, respectively. The feeding coaxial cable 37 is utilized for transmitting/receiving signals, and includes a core conductor 371 connected to the feeding point 35 and a grounding conductor 372 connected to the feeding point 36. Note that, the slit 34 is formed without any bending, or is perpendicular to the first long edge 311 and the second long edge 312.

SUMMARY OF THE INVENTION

It is therefore a primary objective of the claimed invention to provide a digital-television receiving antenna.

According to the claimed invention, a receiving antenna for a digital television comprises a dielectric substrate, a radiating plate formed on the dielectric substrate with a bar shape, having a first long edge and a second long edge corresponding to the first long edge, a slit formed on the radiating plate with a length at least two times the width of the radiating plate, having a terminal at about the center of the first long edge and a terminal at the second long edge, and separating the radiating plate into a first sub-plate and a second sub-plate, a first feeding point formed on the first sub-plate, a second feeding point formed on the second sub-plate, and a feeding coaxial cable having a core conductor connected to the first feeding point and a grounding conductor connected to the second feeding point.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
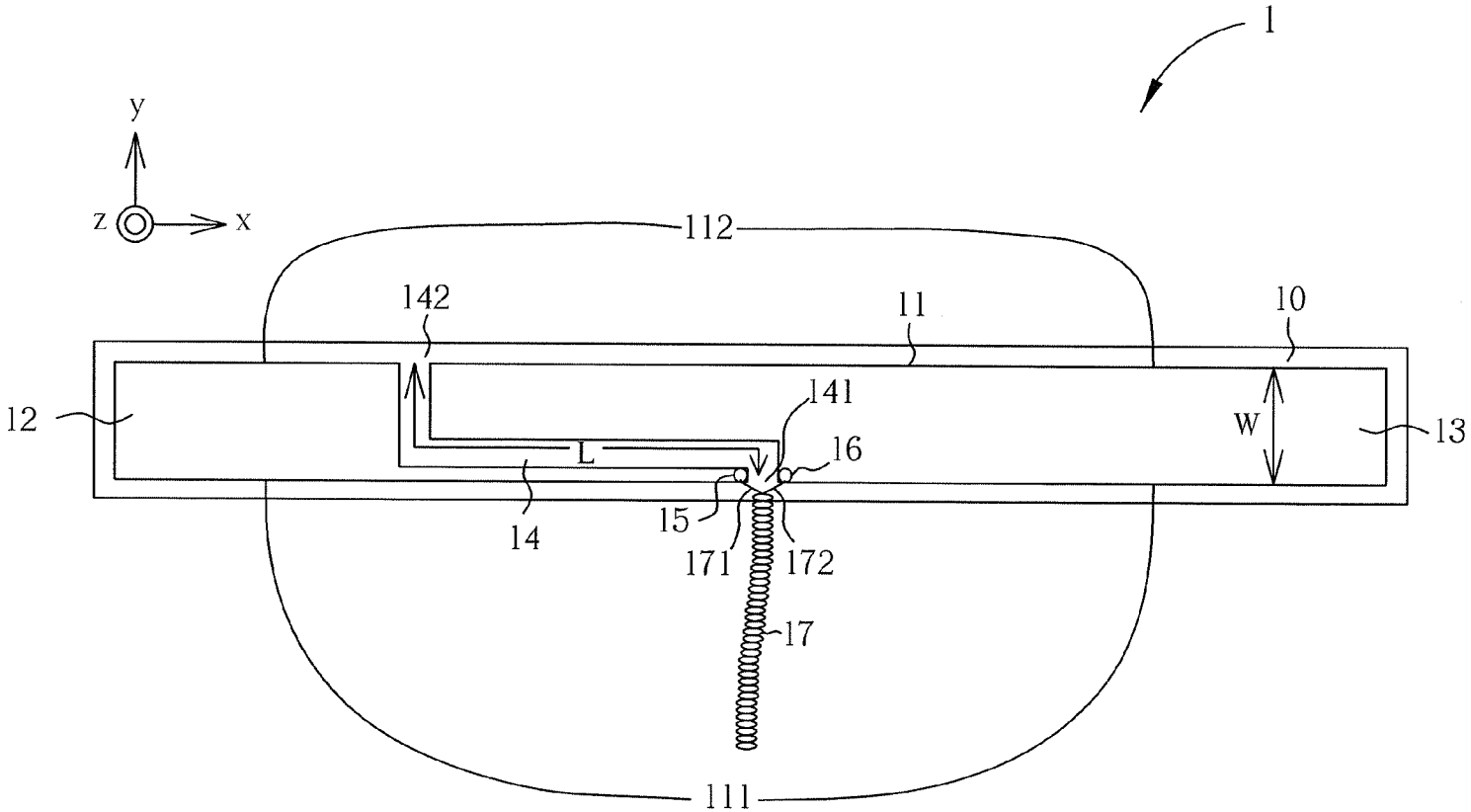
FIG. 1 illustrates a schematic diagram of an antenna in accordance with an embodiment of the present invention.
Figure 2:
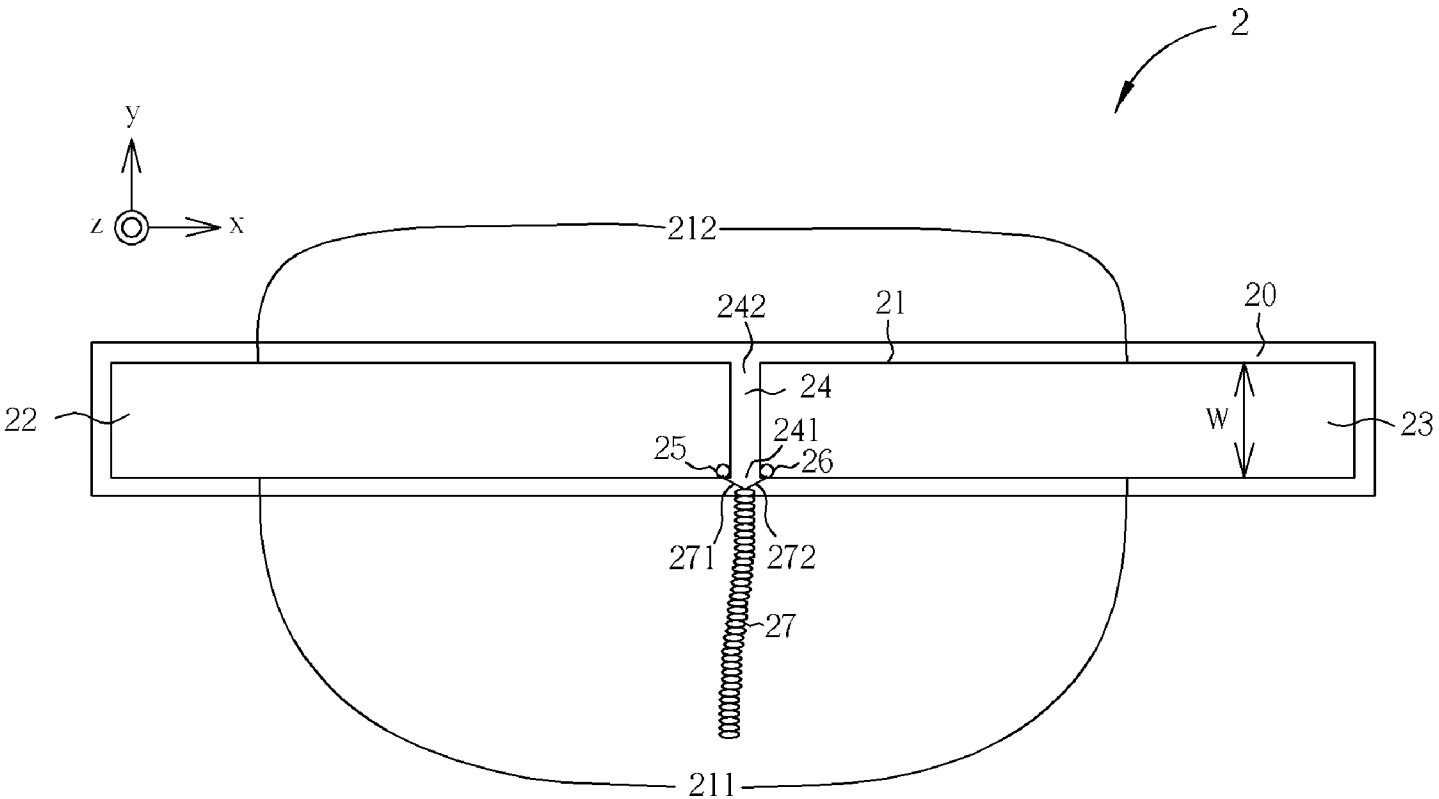
Fig. 2 Prior Art
FIG. 2 illustrates a schematic diagram of an antenna of the prior art.
Figure 3:
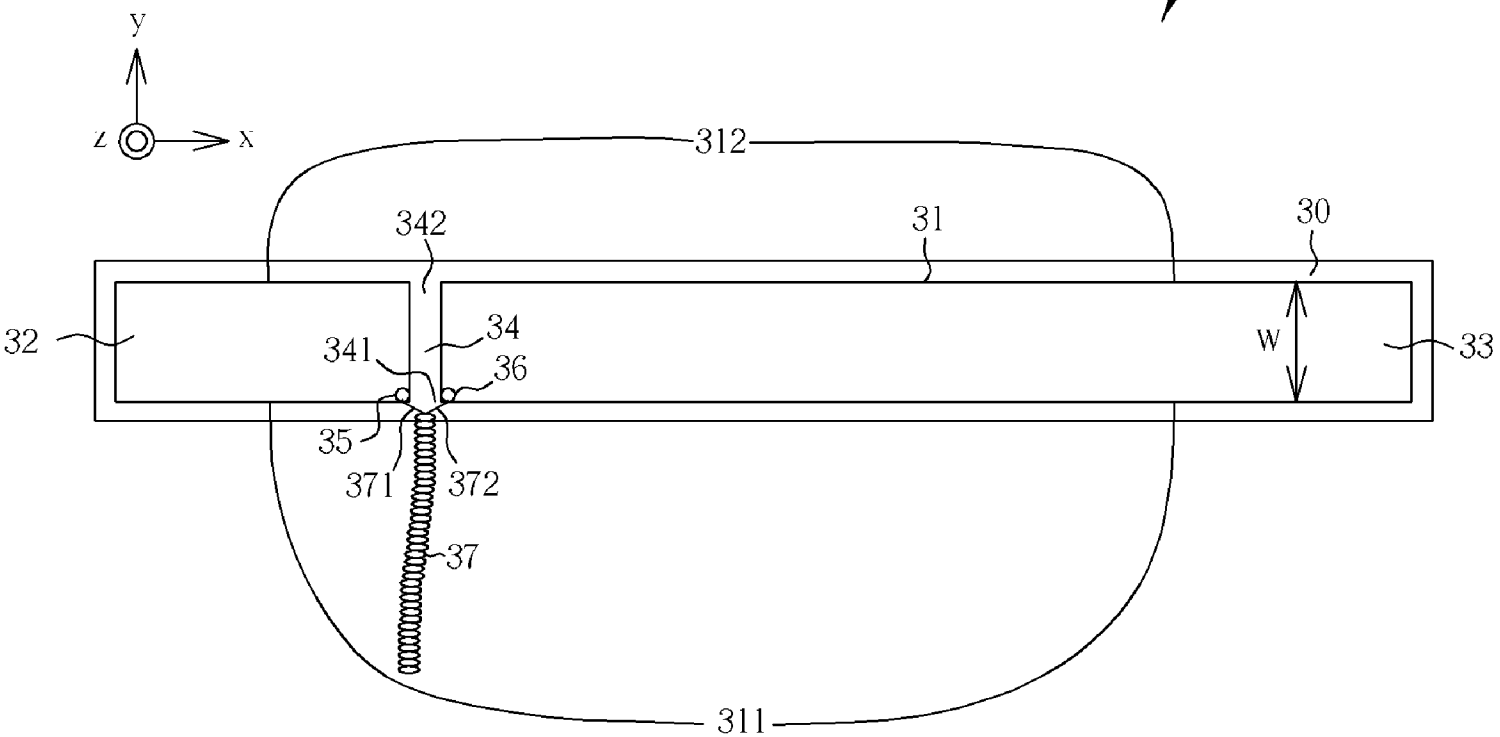
Fig. 3 Prior Art
FIG. 3 illustrates a schematic diagram of an antenna of the prior art.

FIG. 1 illustrates a schematic diagram of an antenna 1 in accordance with an embodiment of the present invention. The antenna 1 includes a dielectric substrate 10, a radiating plate 11, a slit 14, feeding points 15, 16, and a feeding coaxial cable 17. The dielectric substrates 10 can be a copper clad laminate substrate, or be made of film or rubber. The radiating plate 11 is formed on the dielectric substrates 10 by printing or etching. The radiating plate 11 is formed as a bar shape, and includes a first long edge 111 and a second long edge 112, which can be adjacent edges or opposite edges. The length of the slit 14 is longer than the width W of the radiating plate 11 and is preferably at least twice the width W of the radiating plate 11. The slit 14 is preferably of a step shape and includes terminals 141 and 142. The terminal 141 is at about the center of the first long edge 111, while the terminal 142 is at the second long edge 112. The slit 14 separates the radiating plate 11 into a first sub-plate 12 and a second sub-plate 13. The feeding points 15 and 16 are near the first long edge 111, and at the first sub-plate 12 and the second sub-plate 13, respectively. The feeding coaxial cable 17 is utilized for transmitting/receiving signals, and includes a core conductor 171 connected to the feeding point 15 and a grounding conductor 172 connected to the feeding point 16.

Figure 4:
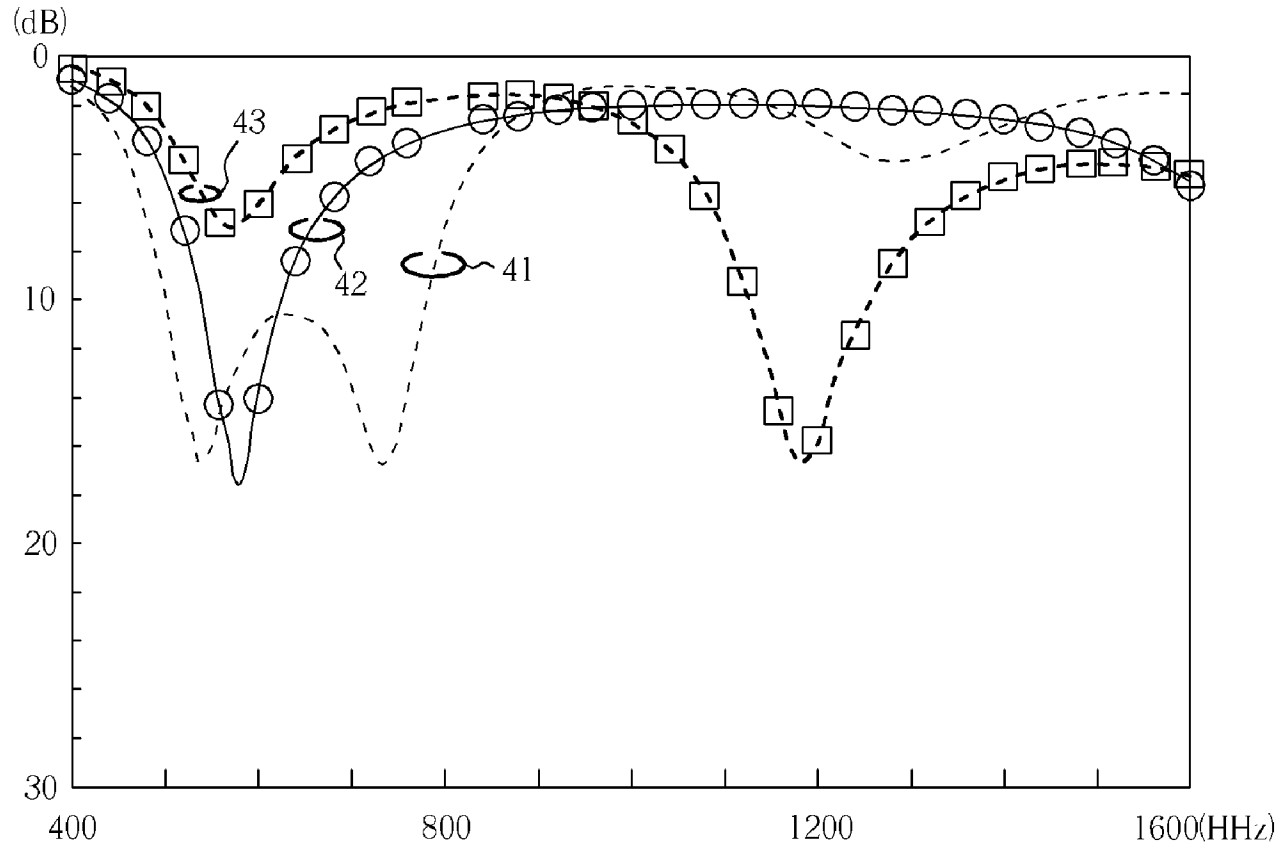
FIG. 4 illustrates a schematic diagram of measured return loss of the antennas shown in FIG. 1, FIG. 2, and FIG. 3.

To show the advantages of the present invention, please refer to FIG. 4, which illustrates a schematic diagram of measured return loss of the antennas 1, 2 and 3. In the experiments, the radiating plate 11, the radiating plate 21, and the radiating plate 31 are 235 mm long and 20 mm wide. A total length and a width of the slit 14 are 80 mm and 1 mm. The terminal 141 is at about the center of the first long edge 111, while the terminal 142 is at about 60 mm from the center of the second long edge 112. The length of the slit 24 is approximately equal to the width of the radiating plate 21, or about 20 mm. The terminals 241 and 242 are at about the centers of the first long edge 211 and the second long edge 212. The length of the slit 34 is approximately equal to the width of the radiating plate 31, or about 20 mm. The terminals 341 and 342 are at about 60 mm from the centers of the first long edge 311 and the second long edge 312. In FIG. 4, y-axis represents values of return loss, and x-axis represents operating frequencies. Curves 41, 42, and 43 represent the measured return loss corresponding to the antennas 1, 2, and 3. As shown in FIG. 4, the antenna 2 of the prior art is excited as a half-wavelength antenna at about 550 MHz, while antenna 3 of the prior art is excited not only as a half-wavelength antenna at about 550 MHz, but also as a full-wavelength antenna at about 1150 MHz due to the 60-mm shift of the slit 34 from the center of the radiating plate 31. Antenna 1 of the present invention adds bending in the slit 14, so that a half-wavelength mode and a full-wavelength mode can be excited at adjacent frequencies, and then formed into a wide operating band, which covers the 470~806 MHz of the DTV band.

Figure 5:
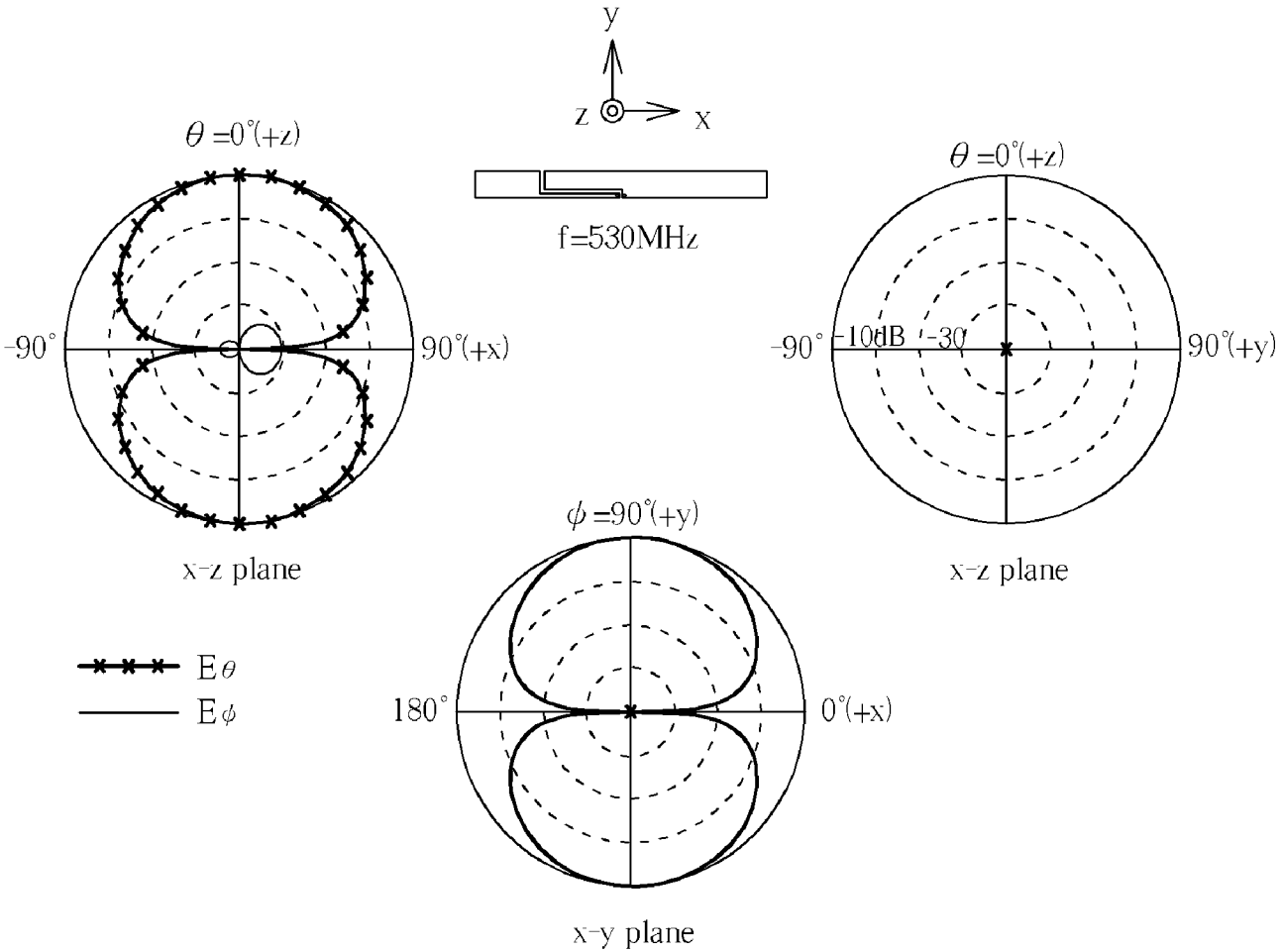
FIG. 5 illustrates a schematic diagram of the radiation pattern of the antenna shown in FIG. 1 at 530 MHz.

FIG. 5 illustrates a schematic diagram of the radiation patterns of the antenna 1 at 530 MHz. As shown in FIG. 5, the radiation patterns of antenna 1 is similar to those of a conventional dipole antenna in the x-z plane, y-z plane, and x-y plane. Therefore, the antenna 1 can meet the requirements for DTV signal reception.

Figure 6:
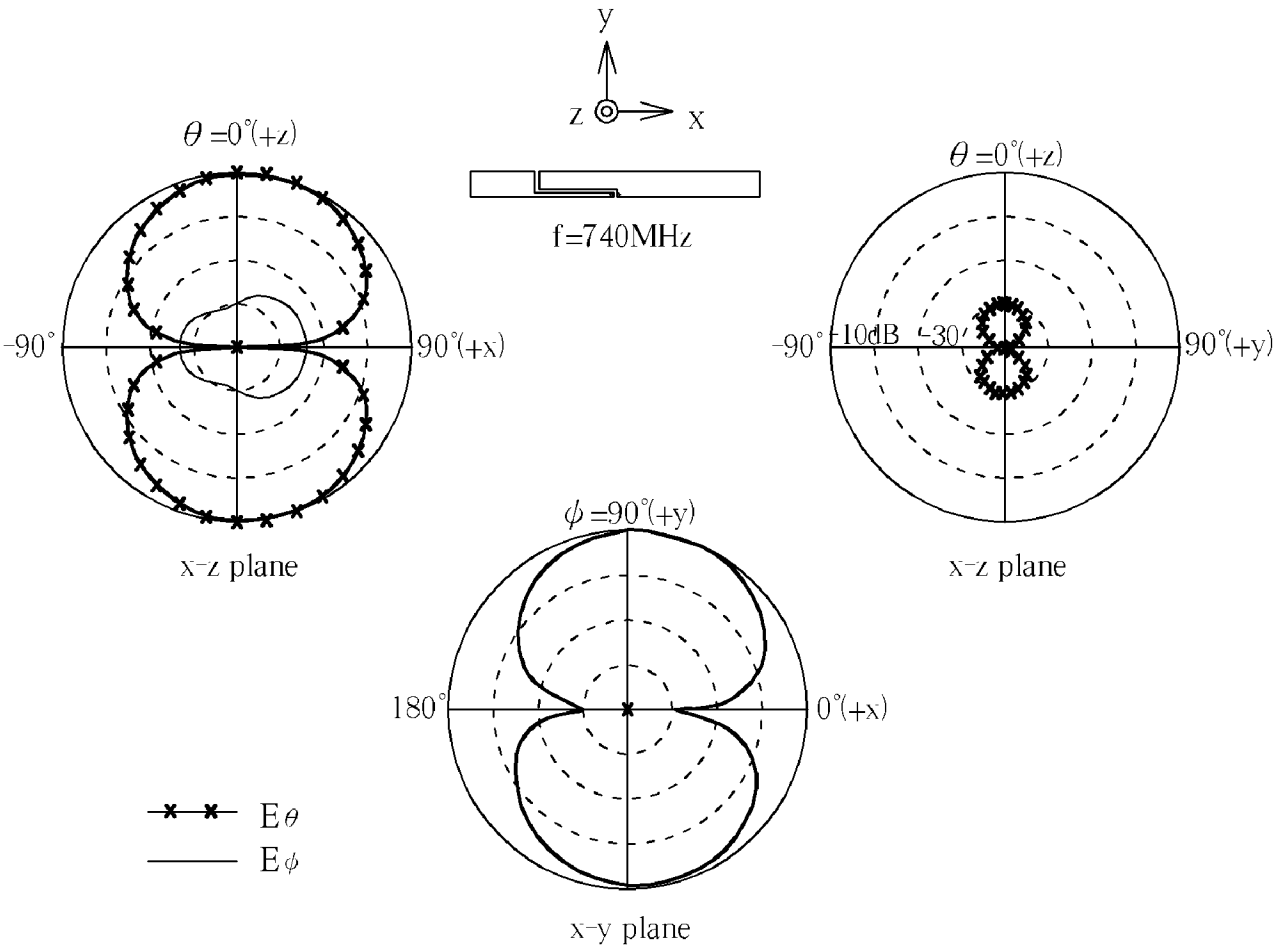
FIG. 6 illustrates a schematic diagram of the radiation pattern of the antenna shown in FIG. 1 at 740 MHz.

FIG. 6 illustrates a schematic diagram of the radiation patterns of the antenna 1 at 740 MHz. As shown in FIG. 6, the radiation patterns of the antenna 1 is similar to those of a conventional dipole antenna in the x-z plane, y-z plane, and x-y plane. Therefore, the antenna 1 again can meet the requirements for DTV signal reception.

Figure 7:
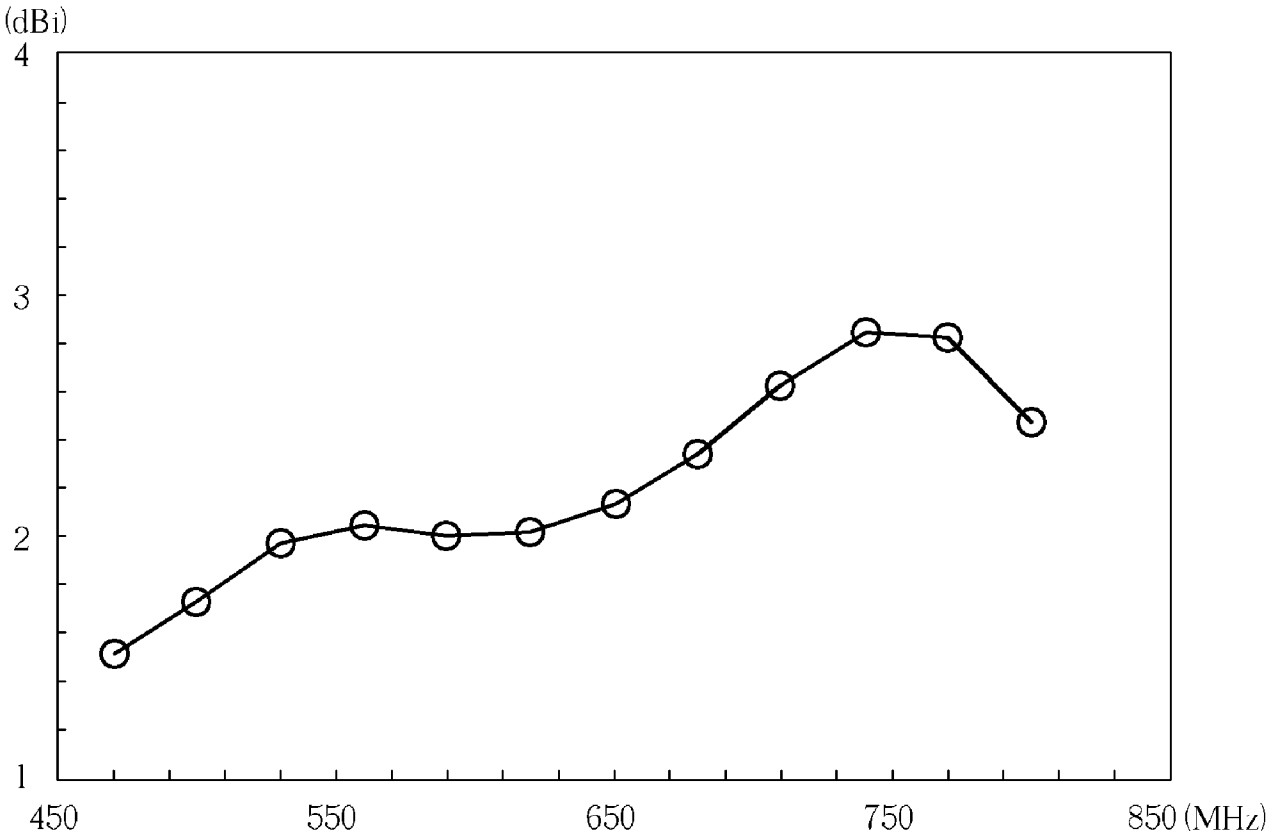
FIG. 7 illustrates a schematic diagram of the antenna gain of the antenna shown in FIG. 1.

FIG. 7 illustrates a schematic diagram of the antenna gain of the antenna 1, where y-axis represents antenna gain, and x-axis represents operating frequencies. As shown in FIG. 7, the antenna gain of the antenna 1 are about 1.5 to 3.0 dBi over the 470~806 MHz DTV band, which are good for practical applications for DTV signal reception.

Figure 8:
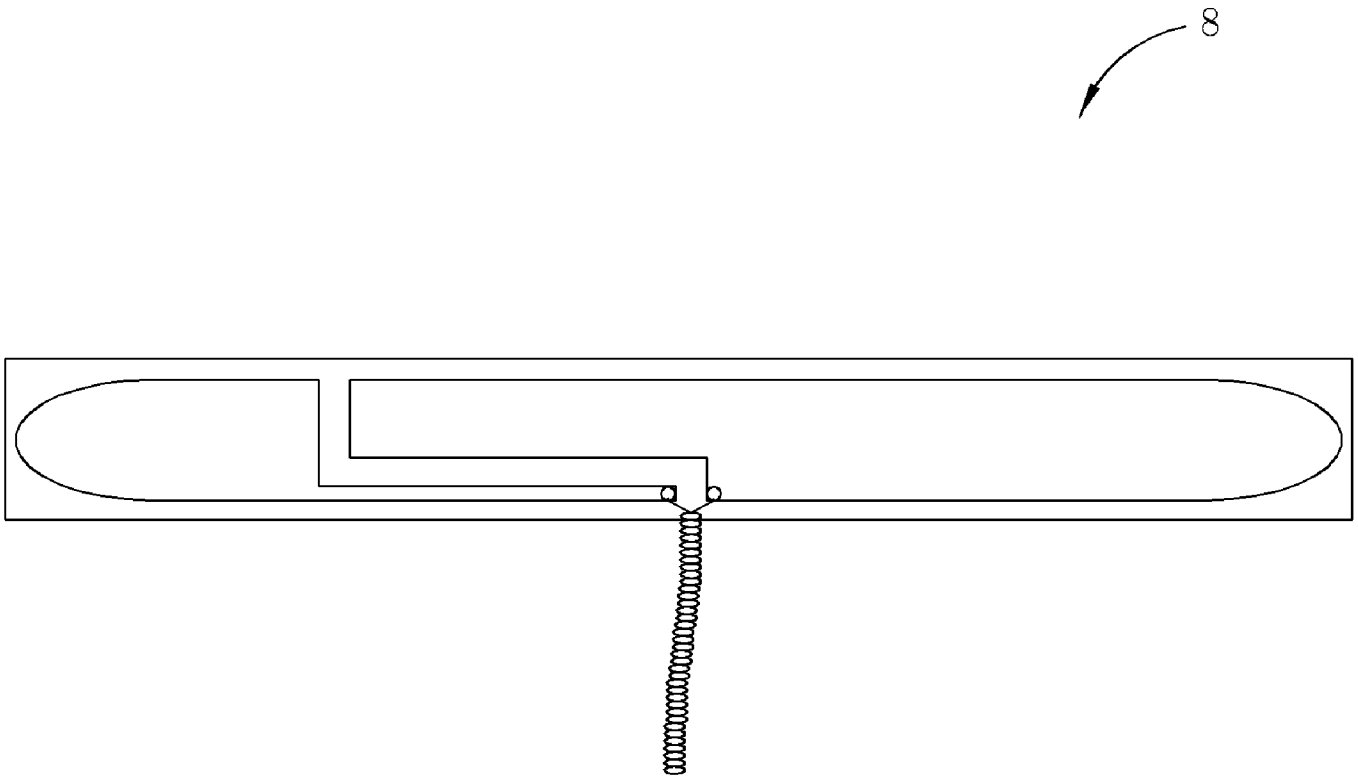
FIG. 8, FIG. 9, and FIG. 10, illustrate schematic diagrams of the antennas in accordance with embodiments of the present invention.
Figure 9:
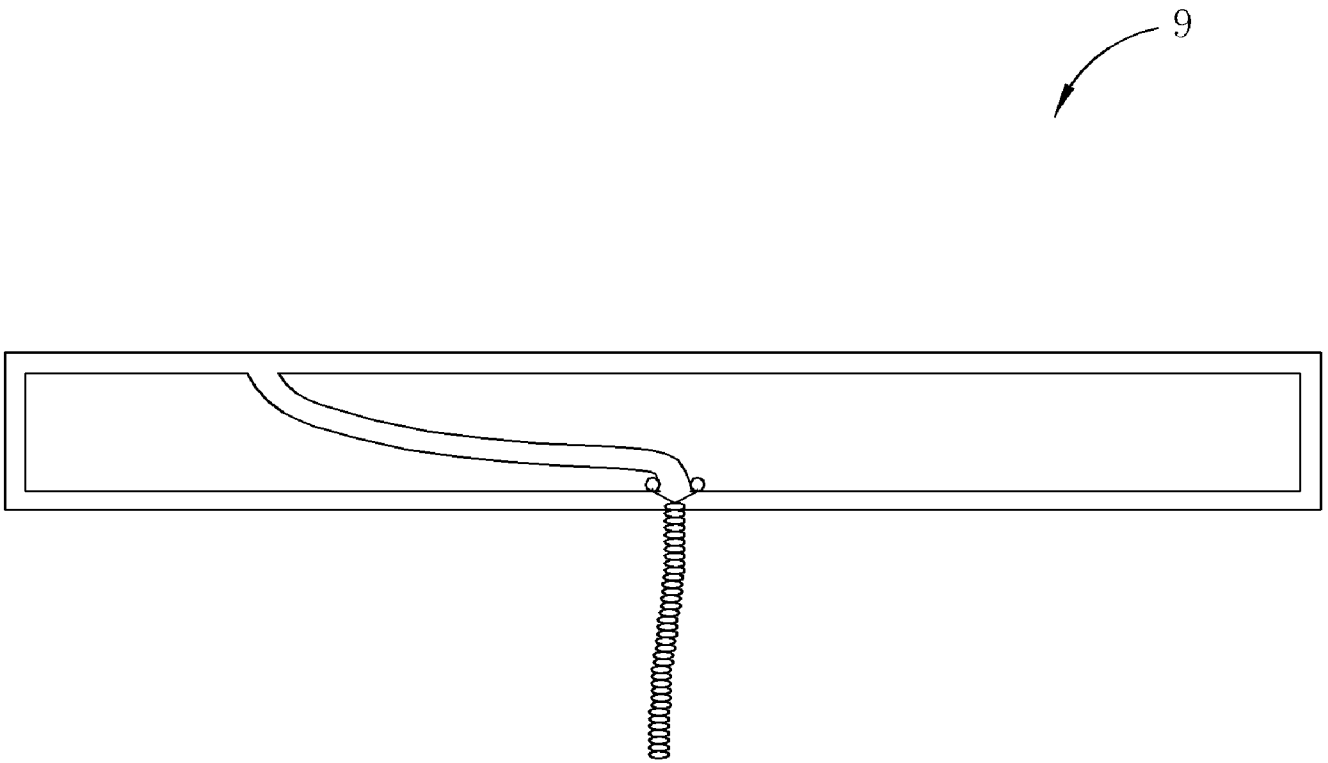
Figure 10:
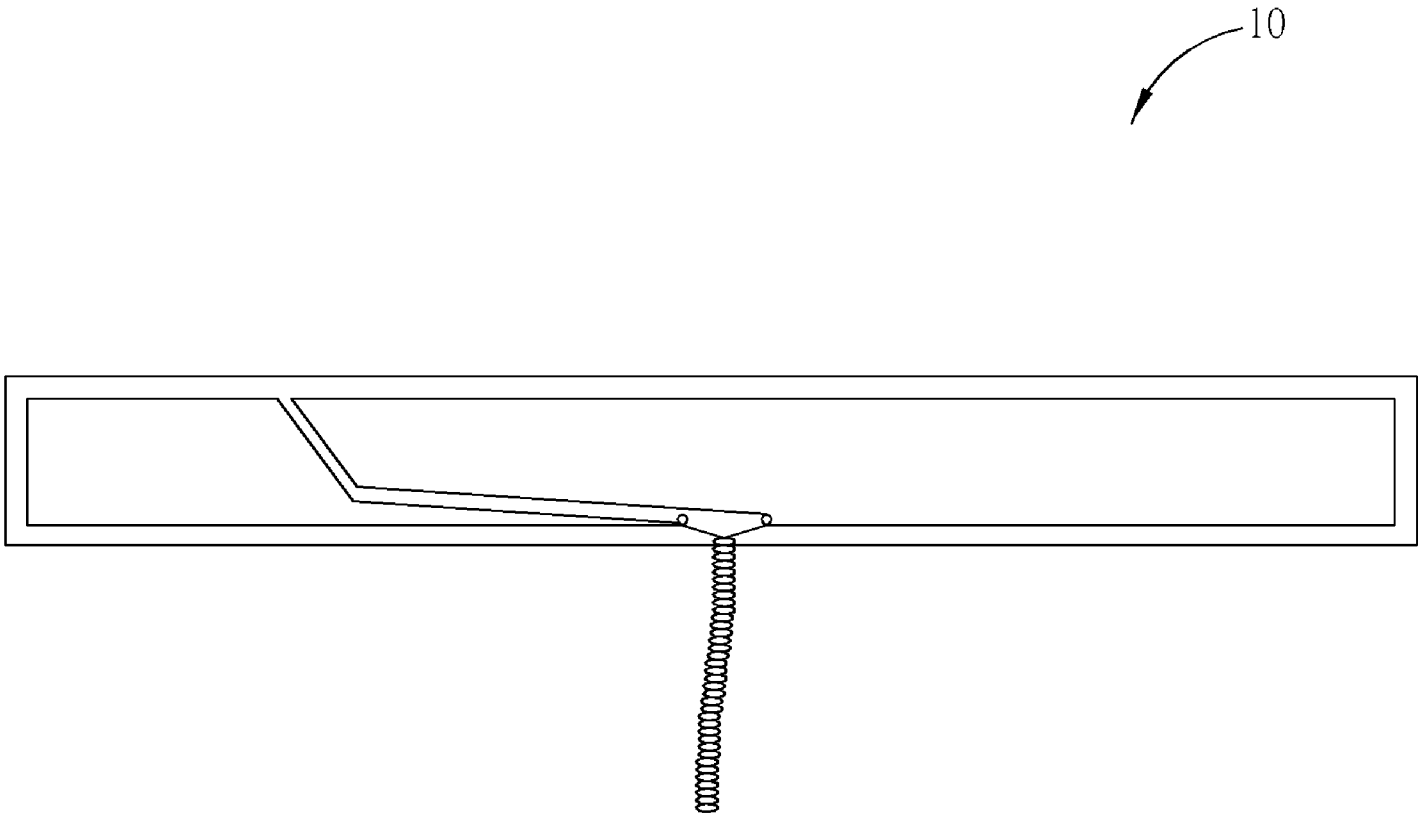

Notice that, the antenna 1 shown in FIG. 1 is only an exemplary embodiment of the present invention. Those skilled in the art can make alternations according to the antenna 1. For example, please refer to FIG. 8, FIG. 9, and FIG. 10, illustrating schematic diagrams of the antennas 8, 9, and 10 in accordance with embodiments of the present invention. The antennas 8, 9, and 10 are similar to the antenna 1, except that a radiating plate of the antenna 8 is formed as a smooth-shaped bar, a slit of the antenna 9 is formed along a smooth curve, and a slit of the antenna 10 includes one bending only.

In summary, the present invention of planar antenna conforms to DTV signal reception requirements and has a simple structure, so that the production cost can be expected to be decreased.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A receiving antenna for digital television signal reception, comprising:

a dielectric substrate;

a radiating plate formed on the dielectric substrate with a bar shape, having a first long edge and a second long edge corresponding to the first long edge;

a slit formed on the radiating plate with a length longer than the width of the radiating plate, having a terminal at about the center of the first long edge and a terminal at the second long edge, and separating the radiating plate into a first sub-plate and a second sub-plate, wherein the slit is curve-shaped;

a first feeding point formed on the first sub-plate;

a second feeding point formed on the second sub-plate; and a feeding coaxial cable having a core conductor connected to the first feeding point and a grounding conductor connected to the second feeding point.

2. The receiving antenna of claim 1, wherein the dielectric substrate is a copper clad laminate substrate.

3. The receiving antenna of claim 1, wherein the dielectric substrate is made of film.

4. The receiving antenna of claim 1, wherein the dielectric substrate is a made of rubber.

5. The receiving antenna of claim 1, wherein the radiating plate is formed on the dielectric substrate by printing or etching.

6. The receiving antenna of claim 1, wherein the length of the slit is at least two times the width of the radiating plate.

7. The receiving antenna of claim 1, wherein the first long edge and the second long edge are adjacent edges on the radiating plate.

8. The receiving antenna of claim 1, wherein the first long edge and the second long edge are opposite edges on the radiating plate.

9. A receiving antenna for digital television signal reception, comprising:

a dielectric substrate;

a radiating plate formed on the dielectric substrate with a bar shape, having a first long edge and a second long edge corresponding to the first long edge, wherein the first long edge and the second long edge are opposite edges on the radiating plate;

a slit formed on the radiating plate with a length longer than the width of the radiating plate, having a terminal at about the center of the first long edge and a terminal at the second long edge, and separating the radiating plate into a first sub-plate and a second sub-plate, wherein the slit has one bend only;

a first feeding point formed on the first sub-plate;

a second feeding point formed on the second sub-plate; and a feeding coaxial cable having a core conductor connected to the first feeding point and a grounding conductor connected to the second feeding point.

* * * * *